US005228868A

United States Patent [19]

Igarashi et al.

[11] Patent Number: 5,228,868

[45] Date of Patent: Jul. 20, 1993

[54] ELECTRICAL CONNECTOR HAVING CASE

[75] Inventors: Yoshiaki Igarashi; Naohiko Honma, both of Tokyo, Japan

[73] Assignee: Daiichi Denshi Kogyo Kabushiki Kaisha, Japan

[21] Appl. No.: 782,659

[22] Filed: Oct. 25, 1991

[30] Foreign Application Priority Data

Oct. 29, 1990 [JP] Japan ..... 2-112070[U]

[51] Int. Cl.[5] ..... H01R 13/52; H01R 13/648

[52] U.S. Cl. ..... 439/465; 439/610; 264/263

[58] Field of Search ..... 439/98, 99, 465, 466, 439/467, 610, 264; 264/263, 272.11

[56] References Cited

U.S. PATENT DOCUMENTS

| | | | |
|---|---|---|---|
| 4,009,923 | 3/1977 | Aistleitner | 439/610 |
| 4,713,023 | 12/1987 | Bixler et al. | 439/610 |
| 4,971,574 | 11/1990 | Garcia | 439/610 |
| 4,981,447 | 1/1991 | Ichitsubo | 439/610 |

FOREIGN PATENT DOCUMENTS 0118168 9/1984 European Pat. Off. .

OTHER PUBLICATIONS

JEE Journal of Electronic Engineering, Vo. 24, No. 249, Sep. 1987, pp. 55-59.

*Primary Examiner*—Gary F. Paumen

*Attorney, Agent, or Firm*—Silverman, Cass & Singer, Ltd.

[57] ABSTRACT

An electrical connector having a cover case for fixing therein the connector. The cover case consists of two case halves arranged one upon the other. The cover case having at a take-up opening of a cable an inner sleeve through which the cable passes. The inner sleeve consists of two semicylinders fixed to the casing halves, respectively. The cover case further has an outer sleeve which, after the inner sleeve is covered by the outer sleeve, is caulked to provide urging force onto the inner sleeve against its outer surface. Abutment edges of the two semicylinders of the inner sleeve are formed as wave-shaped edges waved in the abutment plane of the abutment edges so that the wave-shaped edges of one semicylinder are not coincident with the wave-shape edges of the other semicylinder. In another embodiment, abutment edges of the two semicylinders of the inner sleeve are provided with projecting plate members extending in the abutment plane of the abutment edges. The abutment edges of the two semicylinders are prevented from moving out of abutment with each other when the inner sleeve is subjected to compressive force when the cable is caulked.

5 Claims, 5 Drawing Sheets

ELECTRICAL CONNECTOR HAVING CASE

BACKGROUND OF THE INVENTION

This invention relates to an electrical connector having a case, and more particularly to construction of the cable take-up opening of the cover case of a connector.

An electrical connector concerned with the present invention, which is used for high frequency circuits, includes a case for protection from external noise as shown in FIGS. 1*a* to 1*d*.

In this connector, a metallic cover case 1 formed by an upper case half 1A and a lower case half 1B arranged one on top of the other accommodates therein an electrical connector 3 having therein contacts connected to a cable 2 as shown in the perspective view of FIG. 1*a*. FIG. 1*b*, a perspective view, illustrates a shielding conductor 2*b*, which has been exposed by removal of part of a sheath 2*a*. As clearly shown in the sectional view of FIG. 1*c*, the shielding conductor 2*b* is around the inner sleeve 4 formed by split semicylinders 4*a* and 4*b*, and a cable insulator 2*c* and cores 2*d* are in the inner sleeve 4. An outer sleeve 5 previously fitted on the sheath 2*a* is then positioned on the inner sleeve 4.

Thereafter, the cable 2 is caulked by caulking forces (shown by a number of arrows in FIG. 1*c*) with a caulking tool (not shown) to be deformed into a shape having a circular (in this example) or hexagonal crosssection. Finally, the cable 2 is accommodated in an insulating hood 6 previously fitted on the sheath 2*a* of the cable 2 to complete the connector as shown in FIG. 1*d*. Other parts provided if required and not essential for understanding the invention, such as locking means for locking the connector to a mating connector are not shown in FIGS. 1*a* to 1*d*.

With the construction of the connector described above, when the cable is caulked as shown in FIG. 1*c*, caulking forces are applied to the cable. In most cases, edges 4*al* and 4*bl* of the two semicylinders 4*a* and 4*b* forming the inner sleeve 4 (see FIG. 1*e*) do not snugly abut against each other. In general, the cable is caulked with the edges 4*al* and 4*bl* being shifted and overlapped as shown in FIG. 1*e*. As a result, the thus caulked cable does not hold well and if an external tensile force is applied to the cable in use, the force detrimentally affects connections of the contacts in the connector, resulting in faults in the connections which causes unstable contact between the shielding conductor 2*b*, and the cover case 1. In addition, the caulked quality of the connectors depends upon the shifted and overlapped orientation of the edges 4*al* and 4*bl* of the two semicylinders 4*a* and 4*b*. Therefore, it is impossible to provide connector products uniform in self-holding.

SUMMARY OF THE INVENTION

It is an object of the invention to provide an electrical connector having a case, whose lapping portions of the cover case are constructed so as to solve the problems of the prior art such as unstable holding of a cable onto the cover case due to shifted or overlapped edges of semicylinders of an inner sleeve.

In order to accomplish the object, in an electrical connector having a cover case for fixing therein said connector, said cover case consisting of two case halves arranged one upon the other, said cover case having at a take-up opening of a cable to be connected to the connector an inner sleeve through which the cable passes, said inner sleeve consisting of two semicylinders fixed to the case halves, respectively, and said cover case further having an outer sleeve which, after covering said inner sleeve, is caulked to urge the inner sleeve on its outer side, according to the invention abutment edges of the two semicylinders of the inner sleeve are wave-shaped edges which are waved in the abutment plane of the abutment edges so that the wave-shaped edges of one semicylinder are not coincident with the wave-shaped edges of the other semicylinder.

In another aspect of the invention, abutment edges of the two semicylinders of the inner sleeve are provided with projecting plate members extending in the abutment plane of the abutment edges so that the projecting plate members abut against each other when the two semicylinders are fitted with each other to form the inner sleeve.

According to the invention, the abutment edges of the two semicylinders of the inner sleeve are provided with wave-shaped edges or projecting plate members to increase the security of abutment of the longitudinal edges so that abutment edges of the two semicylinders are prevented from moving out of the abutment against each other when the inner sleeve is subjected to compressive force from the outer sleeve due to caulking. Therefore, the cable can be securely held to the cover case of the connector, while if the shielding conductor is connected to the cover case for grounding, electrical connection therebetween is positively effected so that reliable shielding of the connector is ensured.

The invention will be more fully understood by referring to the following detailed specification and claims taken in connection with the appended drawings.

DESCRIPTION OF THE PREFERRED EMBODIMENTS

Figure 2:
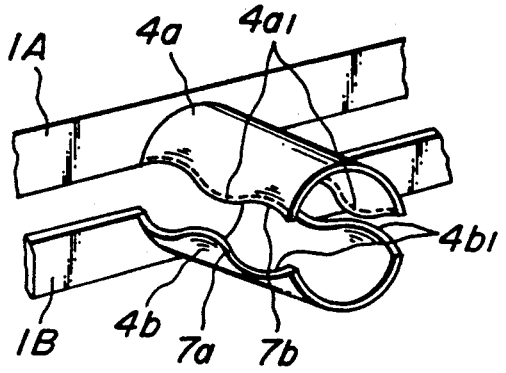
FIG. 2 is a perspective view illustrating a part of a connector according to the invention.
Figure 3:
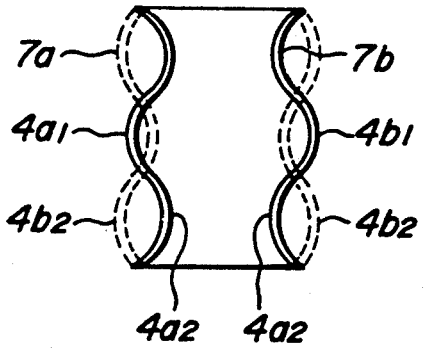
FIG. 3 is a plan view illustrating wave-shaped abutment edges of the inner sleeve of the connector shown in FIG. 2.

FIGS. 2 and 3 illustrate substantially only the inner sleeve of a connector of the first embodiment according to the invention in a perspective and a plan view, respectively. Longitudinal abutment edges 4*al* and 4*bl* of semicylinders 4*a* and 4*b* are deformed to form wave-shaped edges 7*a* and 7*b* so that crests 4*a*2 and 4*b*2 of the wave-shaped edges 7*a* and 7*b* of the longitudinal abutment edges 4*al* and 4*bl* abutting against each other are displaced in the longitudinal direction.

Figure 1A:
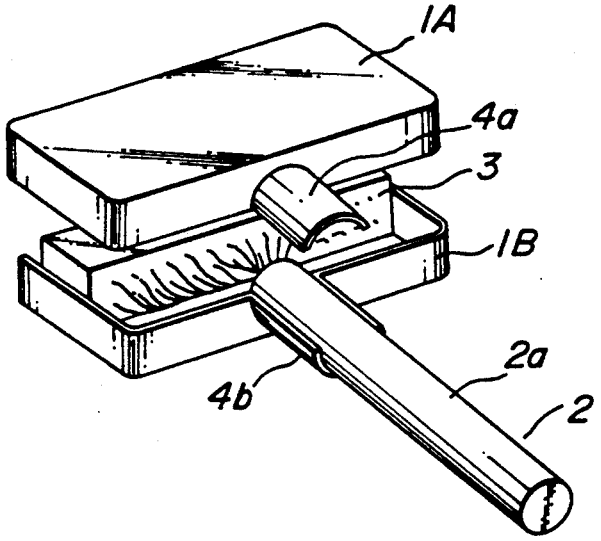
FIG 1a PRIOR ART
FIGS. 1*a*, 1*b*, 1*c*, 1*d* and le are explanatory views illustrating the connector of the prior art.
Figure 1B:
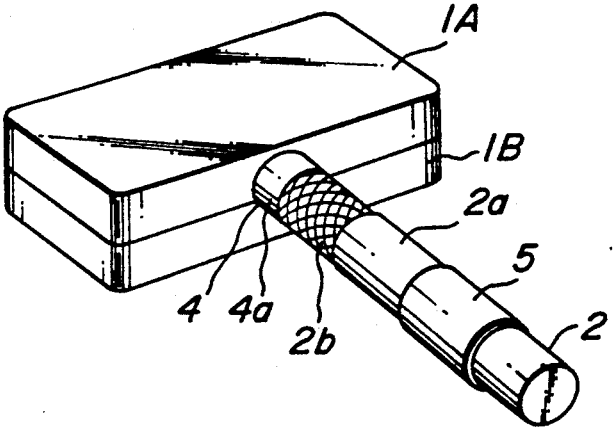
FIG 1b PRIOR ART
Figure 1C:
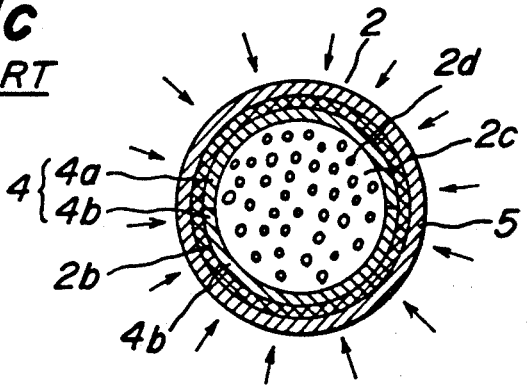
FIG 1c PRIOR ART
Figure 1D:
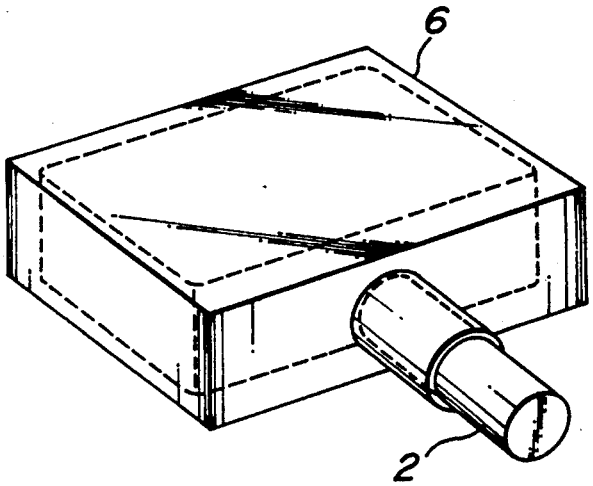
FIG 1d PRIOR ART
Figure 1E:
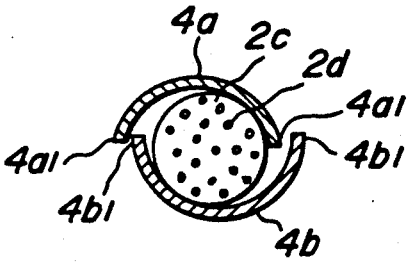
FIG 1e PRIOR ART

In this embodiment, the waves of the waveshaped edges 7*a* and 7*b* are displaced in phase relative to each other by 180° so that the longitudinal abutment edges 4*al* and 4*bl* of the semicylinders 4*a* and 4*b* abut against each other as shown in FIG. 3. As a result, the longitudinal abutment edges 4*al* and 4*bl* do not overlap circumferentially as in the prior art shown in FIG. 1*e*, so long as the crests 4*a*2 or 4*b*2 do not shift in lateral directions in the abutment plane relative to each other more than twice the amplitude of the waves of the wave-shaped edges 7*a* and 7*b*. In this manner, the likelihood of abutment of the longitudinal edges 4*al* and 4*bl* is increased to obtain a connector having a case whose cable is soundly caulked to avoid poor self-holding and faults in electrical connections. In this case, moreover, the cable insulator 2*c* of the cable is deformed following the contour of the wave-shaped edges 7*a* and 7*b* to increase the self-holding of the cable.

The waves of the wave-shaped edges 7*a* and 7*b* of the longitudinal abutment edges 4*al* and 4*bl* as explained are displaced in phase relative to each other by 180°. However, the smaller the relative displacement of the waves and the smaller the amplitude of the waves, of the wave-shaped edges, the smaller is the likelihood of abutment of the longitudinal abutment edges 4*al* and 4*bl*. Therefore, the displacement and the amplitude of the waves of the wave-shaped edges should be suitably selected depending upon factors such as sizes of semicylinders.

Figure 4A:
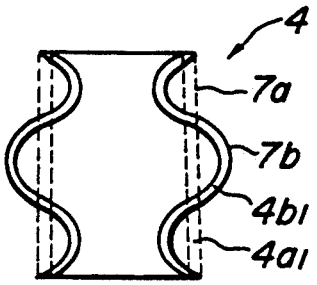
FIGS. 4*a* and 4*b* are plan views illustrating modifications of the abutment edges of the inner sleeve according to the invention.
Figure 4B:
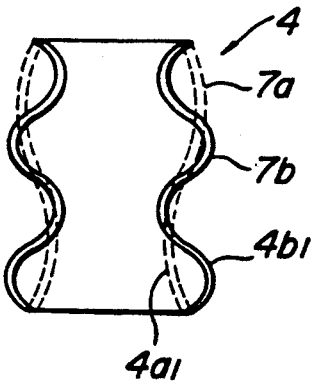

While the waves of the wave-shaped edges 7*a* and 7*b* are formed over the lengths of the semicylinders of the cable in the above embodiment, it will be apparent that they may be formed in a manner different from that as shown. For example, wave-shaped edges may be provided on one semicylinder only as shown in FIG. 4*a*, or waves of wave-shaped edges different in period or wave length may be formed on semicylinders, respectively, as shown in FIG. 4*b*, or waves may be formed in any locations of semicylinders (not shown).

Figure 5:
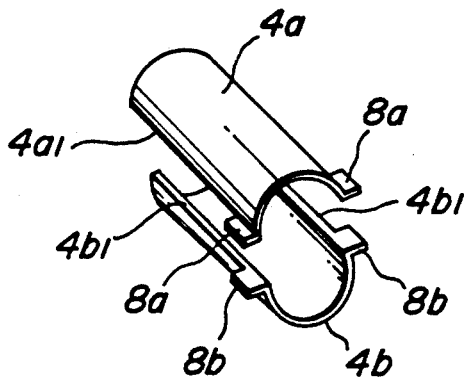
FIG. 5 is a perspective view illustrating an inner sleeve according to another embodiment of the invention.

FIG. 5 illustrates in a perspective view the semicylinders of a connector of the second embodiment of the invention. Longitudinal abutment edges 4*al* and 4*bl* of semicylinders 4*a* and 4*b* are provided with projecting plate members 8*a* and 8*b* extending outwardly in horizontal traverse directions perpendicular to the longitudinal direction of the semicylinders, respectively, thereby increasing the likelihood of abutment of the longitudinal abutment edges of the semicylinders.

Figure 6:
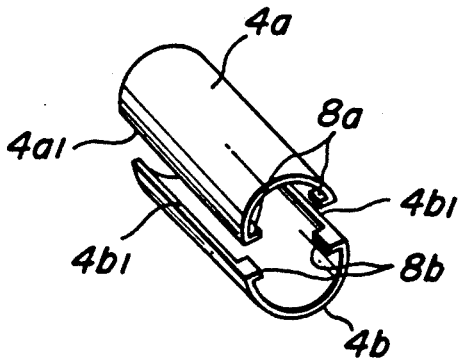
FIG. 6 is a perspective view illustrating a modification of the inner sleeve shown in FIG. 5.

The projecting plate members 8*a* and 8*b* may extend inwardly as shown in FIG. 6, or a plurality of projecting plate members 8*a* and 8*b* may be provided with equal intervals. In the case shown in FIG. 6, when being caulked, the projecting plate members 8*a* and 8*b* bite the insulator 2*c* of a cable to increase the selfholding of the cable.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector comprising, a cover case for fixing therein said connector, said cover case including two case halves arranged one upon the other, said cover case having at an opening for a cable to be connected to the connector an inner sleeve through which the cable passes, said inner sleeve including two semicylinders fixed to the case halves, respectively, said semicylinders having abutment edges adapted to engage each other in an abutment plane, said cover case including an outer sleeve which, after covering said inner sleeve, is caulked to urge the inner sleeve on the outer surface thereof, at least one of said abutment edges being wave-shaped such that the wave-shaped edges of said one semicylinder are not coincident with the edges of the other semicylinder when said abutment edges are engaged with each other.

2. The electrical connector as set forth in claim 1, wherein the abutment edges of both semicylinders are wave-shaped.

3. The electrical connector as set forth in claim 2, wherein the waves of said abutment edges of the two semicylinders are equal in period but different in phase.

4. The electrical connector as set forth in claim 3, wherein the waves of the abutment edges of one semicylinder are 180° displaced in phase from the wave of the abutment edges of the other semicylinder.

5. The electrical connector as set forth in claim 2, wherein the waves of said abutment edges of the two cylinders are different in wave length.

* * * * *

UNITED STATES PATENT AND TRADEMARK OFFICE

CERTIFICATE OF CORRECTION

PATENT NO. : 5,228,868
DATED : July 20, 1993
INVENTOR(S) : Yoshiaki Igarashi and Naohiko Honma It is certified that error appears in the above-indentified patent and that said Letters Patent is hereby corrected as shown below:

Column 1, lines 39, 42, 51, and

Column 2, lines 57, 61, 66, 68, and

Column 3, lines 6, 14, 20-21 and 38, in each instance change "4a1 and 4b1" to

--4a1 and 4b1--.

Column 3, line 17, after "waves" delete the comma (,).

Signed and Sealed this

Fifteenth Day of March, 1994

*Attest:*

*Attesting Officer*

BRUCE LEHMAN

*Commissioner of Patents and Trademarks*